US009284114B2

(12) United States Patent
Hoyle et al.

(10) Patent No.: US 9,284,114 B2
(45) Date of Patent: Mar. 15, 2016

(54) METHOD OF CONSTRUCTION OF PRESTRESSED CONCRETE PANEL WALL LIQUID STORAGE TANK AND TANK SO CONSTRUCTED

(71) Applicants: Kimberly Ann Fernandez Hoyle, Houston, TX (US); Chung-Nan Nancy Tsai, Houston, TX (US)

(72) Inventors: Kimberly Ann Fernandez Hoyle, Houston, TX (US); Chung-Nan Nancy Tsai, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 85 days.

(21) Appl. No.: 14/462,276

(22) Filed: Aug. 18, 2014

(65) Prior Publication Data

US 2016/0046437 A1 Feb. 18, 2016

(51) Int. Cl.

| | |
|---|---|
| ***B65D 88/08*** | (2006.01) |
| ***F17C 13/00*** | (2006.01) |
| ***F17C 3/00*** | (2006.01) |
| ***E04C 2/04*** | (2006.01) |

(52) U.S. Cl.

CPC ..... *B65D 88/08* (2013.01); *E04C 2/044* (2013.01); *F17C 3/00* (2013.01); *E04B 2103/02* (2013.01); *F17C 2201/0104* (2013.01); *F17C 2203/012* (2013.01); *F17C 2205/01* (2013.01); *F17C 2209/22* (2013.01)

(58) Field of Classification Search

CPC ... B65D 88/34; F17C 3/00; F17C 2201/0104; F17C 2209/22; F17C 2203/012; F17C 2205/01; E04C 2/044; E04B 2103/02

See application file for complete search history.

(56) References Cited

U.S. PATENT DOCUMENTS

| | | | | | |
|---|---|---|---|---|---|
| 1,145,306 | A | * | 7/1915 | Griffen | B65D 88/08 217/4 |
| 1,166,987 | A | * | 1/1916 | Hedrick | B65D 88/08 217/4 |
| 2,667,068 | A | * | 1/1954 | Viehe | G01L 1/10 52/223.3 |
| 2,932,964 | A | * | 4/1960 | Dobell | E01C 11/106 220/614 |
| 3,025,992 | A | * | 3/1962 | Humphrey | B65D 90/029 220/4.12 |
| 3,057,054 | A | * | 10/1962 | Barnes | E04H 7/06 220/565 |
| 3,123,942 | A | * | 3/1964 | Stinton | E04G 21/12 242/438.1 |

(Continued)

FOREIGN PATENT DOCUMENTS

| | | | | |
|---|---|---|---|---|
| DE | 2119844 | * | 11/1972 | B65D 88/08 |

*Primary Examiner* — Jeanette E Chapman
(74) *Attorney, Agent, or Firm* — Karen R. DiDomenicis

(57) ABSTRACT

Disclosed is a method for the construction of a prestressed concrete tank for the storage of liquids. The method includes erecting precast concrete panels on a foundation in a generally cylindrical shape while allowing an opening to allow the passage of people and equipment there through during the construction of the tank. Anchors are provided along both vertical edges of the opening. Strands are inserted into the anchors along both vertical edges of the opening and wire wrapped under tension over the outer surface of the inner tank wall. In one embodiment, a structural frame is secured within the opening and the strands are anchored to the vertical members of the structural frame. Once the opening in the tank wall is no longer needed, the opening is sealed with concrete panels. The sealed opening is then wire wrapped under tension using strands anchored to the anchors provided along both vertical edges of the opening.

11 Claims, 8 Drawing Sheets

(56) References Cited

U.S. PATENT DOCUMENTS 3,404,500 A * 10/1968 Akita ..... B65D 88/76 220/565
3,524,780 A * 8/1970 Clements ..... B29D 22/00 156/175
3,711,361 A * 1/1973 Casadevall ..... B29B 15/08 156/172
4,163,347 A * 8/1979 Marcmann ..... B65D 90/06 177/233
4,458,458 A * 7/1984 Orii ..... B65D 90/043 220/694
4,513,550 A * 4/1985 Kotcharian ..... F17C 3/022 220/560.3
4,821,915 A * 4/1989 Mayer ..... B65D 90/501 220/4.12
5,134,830 A * 8/1992 Dykmans ..... B65D 88/34 264/32
5,177,919 A * 1/1993 Dykmans ..... B65D 88/34 405/229
5,308,423 A * 5/1994 Kauffman ..... B29C 70/086 156/171
2006/0037278 A1* 2/2006 Crane ..... E04H 7/20 52/745.01
2011/0099940 A1* 5/2011 Yang ..... F17C 1/08 52/742.14
2012/0023845 A1* 2/2012 Shockley ..... E04C 3/22 52/223.7

* cited by examiner

METHOD OF CONSTRUCTION OF PRESTRESSED CONCRETE PANEL WALL LIQUID STORAGE TANK AND TANK SO CONSTRUCTED

FIELD

The present disclosure relates to methods for the construction of cylindrical liquid storage tanks, and in particular storage tanks made from prestressed concrete panel walls.

BACKGROUND

Large capacity liquid storage tanks ranging in capacity from 100,000 gallons to over 20,000,000 gallons are frequently built from prestressed concrete panels to ensure long-term structural reliability. Cylindrical liquid storage tanks made from concrete panel walls can be prestressed through the use of wrapping the full circumference of the tank with wire or strands in order to ensure that the tank walls are in compression thereby counterbalancing the force of the liquid on the interior of the tank walls.

During the construction of many large liquid storage tanks, after the wire wrapping, also referred to as the prestressing, of the tank, access to the interior of the tank is required. For instance, such access is required to complete the installation of tank elements such as a pump well and associated equipment such as pumps. In order to provide such access, an underground tunnel can be dug. FIG. 1 illustrates such a tank 10 and an associated underground access tunnel 3 provided to allow access from the exterior of the tank to the tank interior 24. The tank 10 includes a primary, inner tank wall 16 made from concrete panels 18. The inner tank is prestressed using cables 20. Reference numeral 28 refers to a cutaway edge so that the tank interior 24 can be seen. In the tank interior 24 can be seen the interior tunnel access 7 and the tank floor 22. A secondary, outer tank wall 12 surrounds the inner tank. The outer tank is also made from concrete panels 13. Reference numeral 30 refers to a cutaway edge so that the exterior of the inner tank wall 16 can be seen. Both the inner tank and the outer tank are situated on a foundation 14 on the ground 1. The exterior tunnel access 5 is shown as a hole in the ground 1.

The tunnel 3 shown in FIG. 1 is not intended to be shown to scale. Providing such tunnels is often very challenging, involving time-consuming and expensive engineering design work, labor and materials. While having bedrock as a foundation for the tank is desirable from a seismic stability point of view, such ground conditions are quite undesirable for tunneling through because of the hardness of the rock and soil. Tunnels carry the potential risk of at least partial collapse during the excavation and building of the tunnel. Excavating tunnels requires expensive equipment and materials to ensure safety and stability. Once the construction of the tank 10 is completed, the tunnel 3 is no longer needed.

It would be desirable to have a way to provide an opening in the primary and secondary containment tanks during the construction of prestressed panel wall storage tanks so that the practice of providing an underground access tunnel could be avoided.

SUMMARY

In one aspect, a method for constructing a storage tank having a generally cylindrical shape is provided. The method includes first constructing an inner tank wall comprising concrete panels on a foundation wherein the inner tank wall has an outer surface and an opening in the inner tank wall defined by an opening height and two vertical edges spaced a width apart, the opening provided to allow the passage of people and equipment there through during construction of the storage tank. At least a first elongated tensile member is anchored to the outer surface of the inner tank wall at a first plurality of locations along one of the two vertical edges adjacent the opening. The at least a first elongated tensile member is used to wrap the outer surface of the inner tank wall. The at least a first elongated tensile member is anchored to the outer surface of the inner tank wall at a second plurality of locations along the other of the two vertical edges adjacent the opening such that each of the first plurality of locations is horizontally aligned with each of the second plurality of locations. Concrete panels are then installed in the opening in the inner tank wall to create a sealed opening. At least a second elongated tensile member is anchored to the outer surface of the inner tank wall at a first plurality of locations along one of the two vertical edges adjacent the opening. The sealed opening is wrapped with the at least a second elongated tensile member. The at least a second elongated tensile member is then anchored to the outer surface of the inner tank wall at a second plurality of locations along the other of the two vertical edges adjacent the opening.

In one aspect, a partially constructed, generally cylindrical prestressed concrete tank provided with an opening to allow the ingress and egress of people and equipment during construction thereof is provided. The tank includes a tank wall comprising a plurality of concrete panels on a foundation wherein the tank wall has an outer surface and an opening in the tank wall defined by an opening height and two vertical edges spaced a width apart, the opening provided to allow the passage of people and equipment through the tank wall. The tank includes a first plurality of anchors secured along one of the two vertical edges adjacent the opening; a second plurality of anchors secured along the other of the two vertical edges adjacent the opening such that each of the second plurality of anchors is horizontally aligned with each of the first plurality of anchors; and at least a first elongated tensile member extended along the outer surface of the tank wall between and secured by the first plurality of anchors and the second plurality of anchors.

In one aspect, a fully constructed prestressed concrete tank includes the partially constructed, generally cylindrical prestressed concrete tank and further includes a plurality of concrete panels in the opening in the tank wall to create a sealed opening; and at least a second elongated tensile member extended across the sealed opening between and secured by the first plurality of anchors and the second plurality of anchors.

DESCRIPTION OF THE DRAWINGS

These and other objects, features and advantages of the present invention will become better understood with reference to the following description, appended claims and accompanying drawings where:

DETAILED DESCRIPTION

Figure 1:
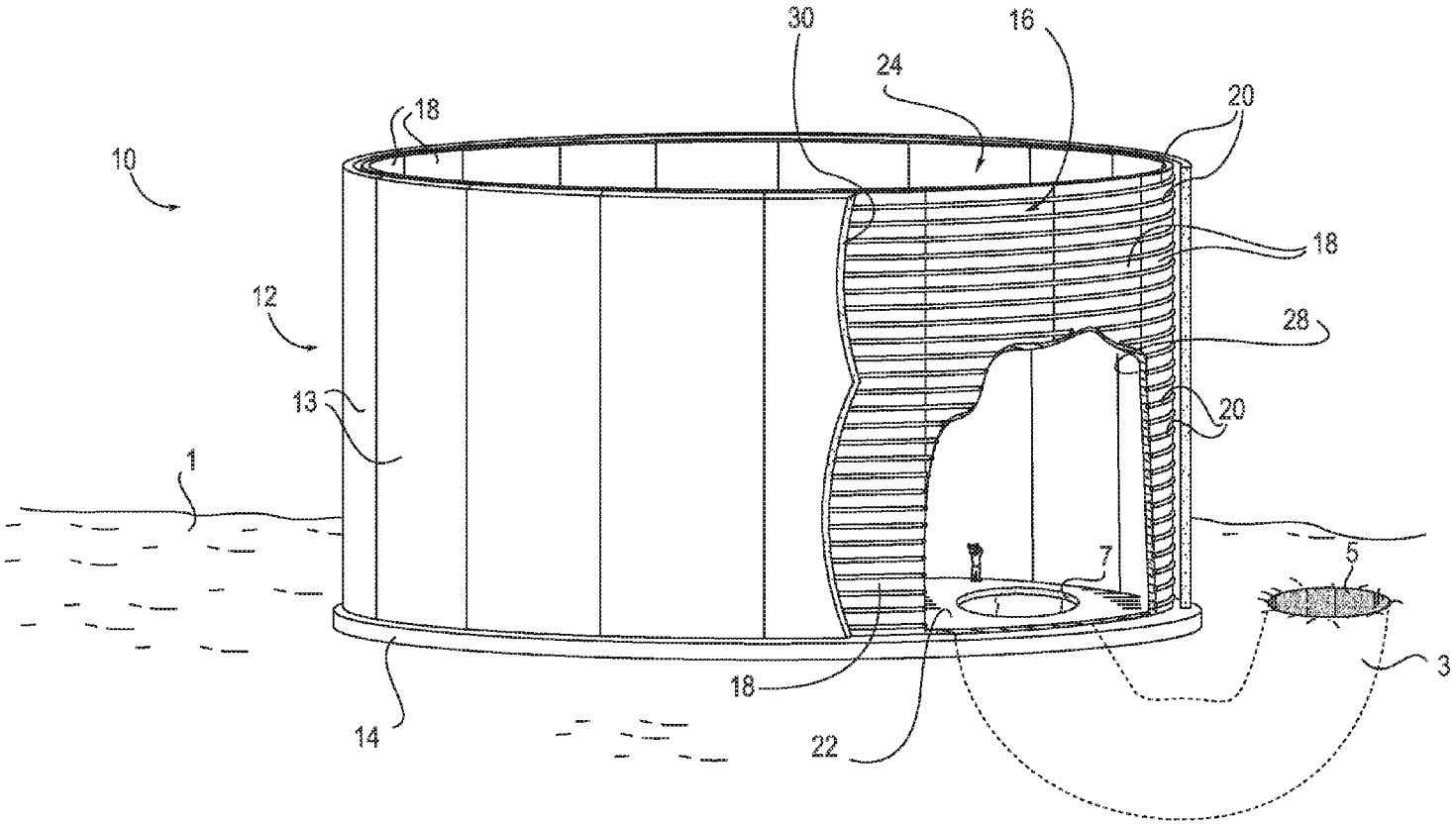
FIG. 1 (Prior Art)
FIG. 1 is an illustration of a liquid storage tank during construction according to the prior art.
Figure 2:
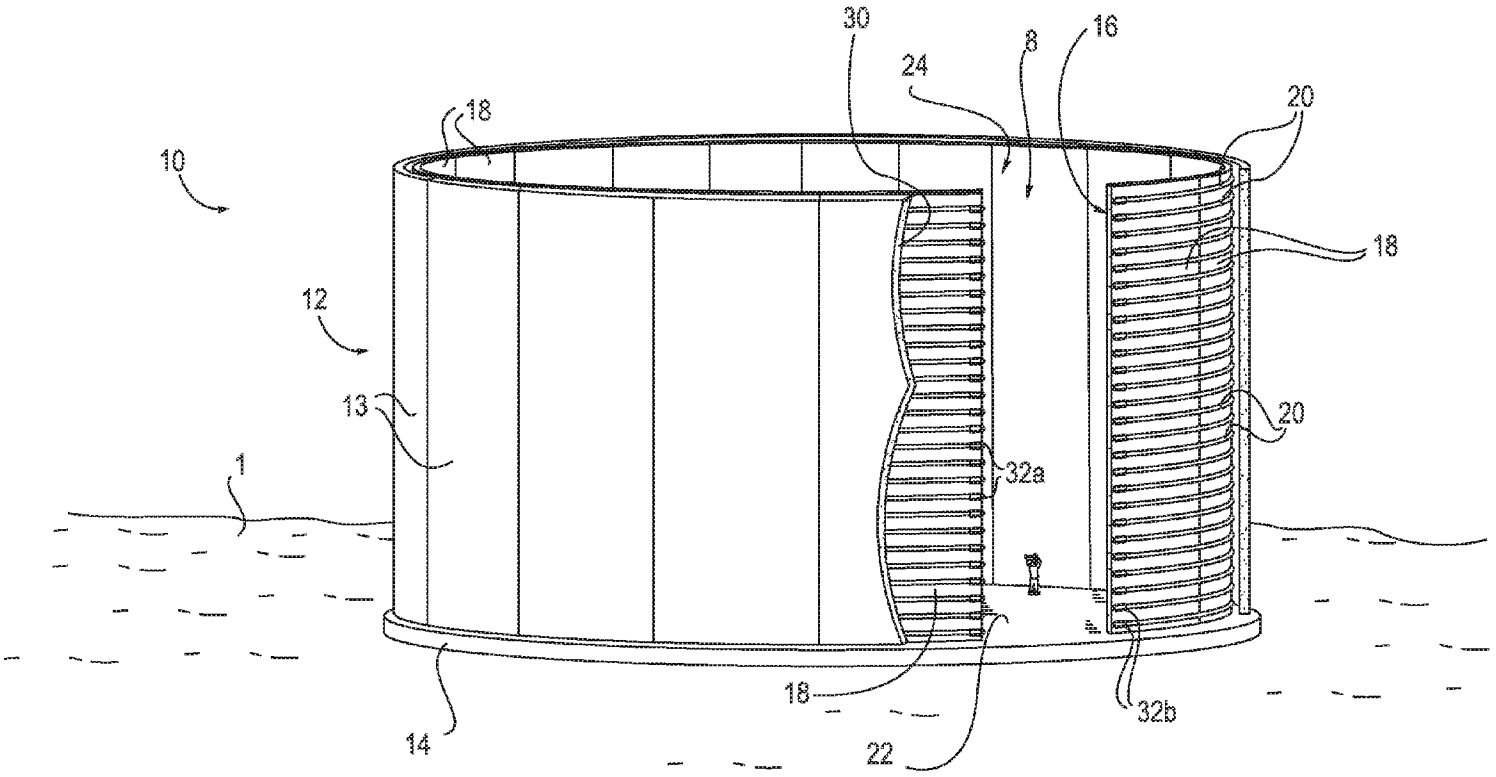
FIG. 2 is an illustration of a liquid storage tank during construction according to one exemplary embodiment.

With reference to FIG. 2, in one embodiment of the present disclosure, a liquid storage tank 10 is constructed. First, a tank wall 16, also referred to herein as an inner tank wall 16, is constructed by erecting concrete panels 18 onto a foundation 14 such as a circular reinforced concrete base positioned at a suitable site on the ground 1. The concrete panels 18 can be joined by any known method such as grouting. The inner tank wall 16 has a generally cylindrical shape. The inner tank wall 16 encloses a tank interior 24 having a floor 22. The inner tank wall 16 can also include an optional metal liner (not shown). Optionally, a secondary outer tank 12 is constructed from outer tank wall panels 14 surrounding the inner tank wall 16. Reference numeral 30 refers to a cutaway edge of the outer tank wall.

The inner tank wall has an opening 8 in the circumference of the inner tank wall 16 provided to allow the passage of people and equipment through the opening 8 during the construction of the storage tank 10. The opening is defined by a height of the opening and two vertical edges of the opening spaced a width apart, so that the opening is a desired size sufficient to allow the ingress and egress of people and equipment through the opening. In one embodiment, the height of the opening is the height of the tank wall.

Along the two vertical edges adjacent the opening 8, anchors 32*a* and 32*b* are provided at a plurality of locations. The anchors 32*a* and 32*b* are securely held in place at the edge of the opening 8 in the inner tank wall 16. The anchors 32*a* and 32*b*, on the two edges respectively, are positioned so that they align with each other horizontally.

Suitable anchors 32*a* and 32*b* include commercially available strand wedge anchors, strand clamp couplers and the like. As nonlimiting examples, strand clamp couplers available from Paul Maschinenfabrik GmbH & Co. (Duermentingen, Germany) and strand anchors available from VSL International Ltd. (St. Légier, Switzerland) can be used. In one embodiment, each of the anchors 32*a* and 32*b* is capable of securely holding two ends of elongated tensile members 20. Into one of the anchors 32*a* or 32*b* is inserted an elongated tensile member 20. The elongated tensile member 20 can be any known strand, cable, wire or tendon having a suitable tensile strength. For convenience, the elongated tensile member 20 is also referred to herein as a "strand" regardless of the exact type of elongated tensile member. The strand 20 can optionally be PVC coated or coated with grease. Nonlimiting examples of suitable strands include ⅜ inch (0.95 cm) diameter strands per ASTM A416 (Grade 270) and wires per ASTM A821. The strand is inserted into the anchor by the method recommended by the anchor manufacturer. Once securely inserted, the outer surface of the inner tank wall 16 can be wrapped by the strand 20 along the circumference of the inner tank wall from one vertical edge of the opening 8 to the other, where the strand 20 can be cut and securely inserted into an anchor 32 (32*a* or 32*b*, depending on which side of the opening 8 the wrapping was started, i.e., which side of the opening 8 the other end of the strand 20 is anchored initially). Additional strands 20 are then likewise wrapped along the outer surface of the inner tank wall 16 and anchored in the anchors 32*a* and 32*b* along each side of the opening 8. Shotcrete (not shown) may optionally be applied over the installed strands 20, with the exception of the anchor points.

The wrapping of the strand 20, also referred to as prestressing of the tank, can be carried out by any suitable method. Commercial machinery is available that is specially designed for such purpose. For example, such wire wrapping machines have been manufactured and are commercially available from DN Tanks, (Wakefield, Mass.), DYK Incorporated (El Cajon, Calif.) and Preload Inc. (Hauppauge, N.Y.). Alternatively, the wrapping of the strand 20 can be carried out using a jack, such as a hydraulic jack.

When the wrapping of the strand 20 is complete, a reinforced concrete upstand ring beam (not shown) can be cast per known method on both sides of each wall panel 18 at the intersection of the wall panel and the foundation 14.

Figure 3A:
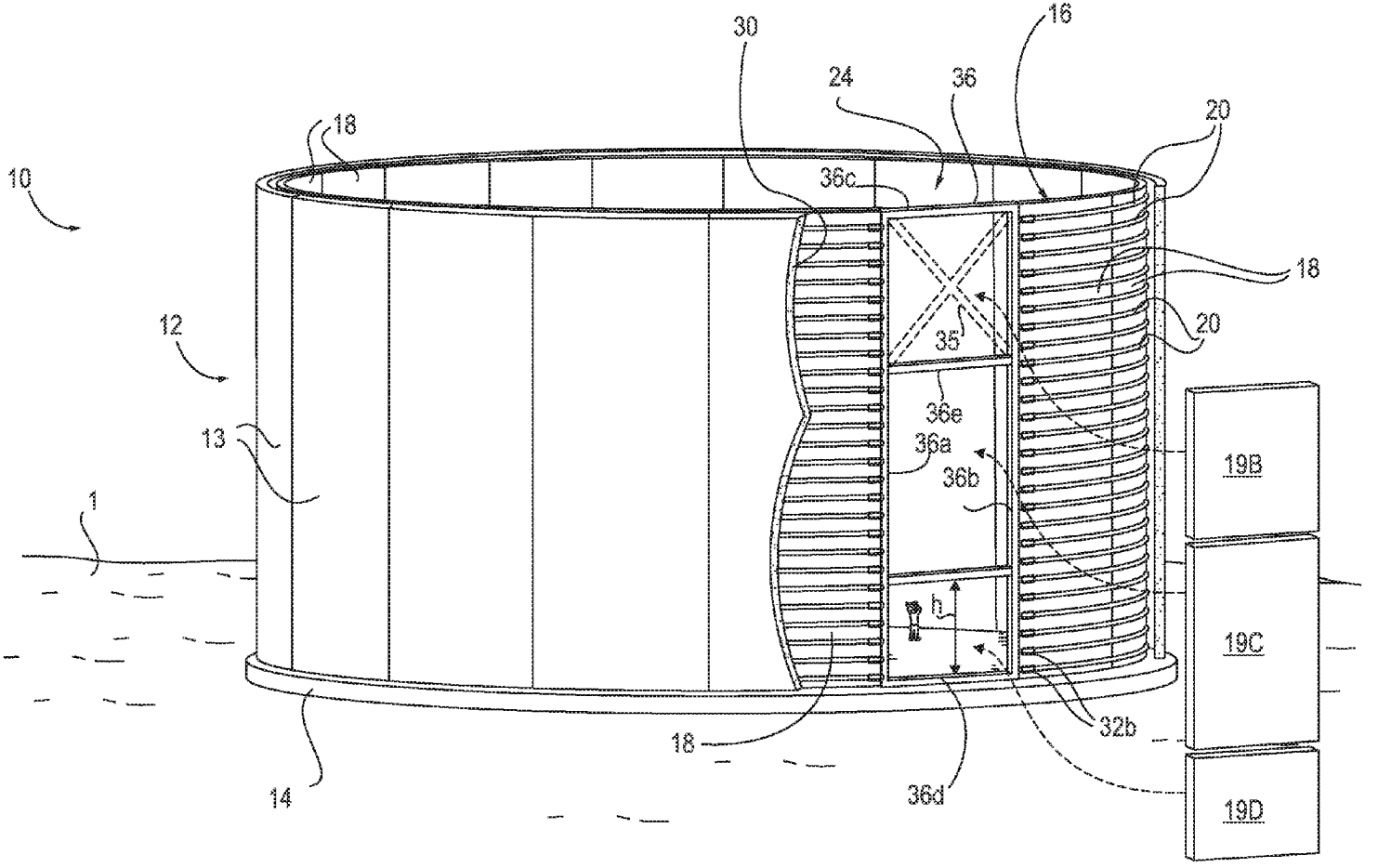
FIG. 3A is an illustration of a liquid storage tank during construction according to another exemplary embodiment.
Figure 3B:
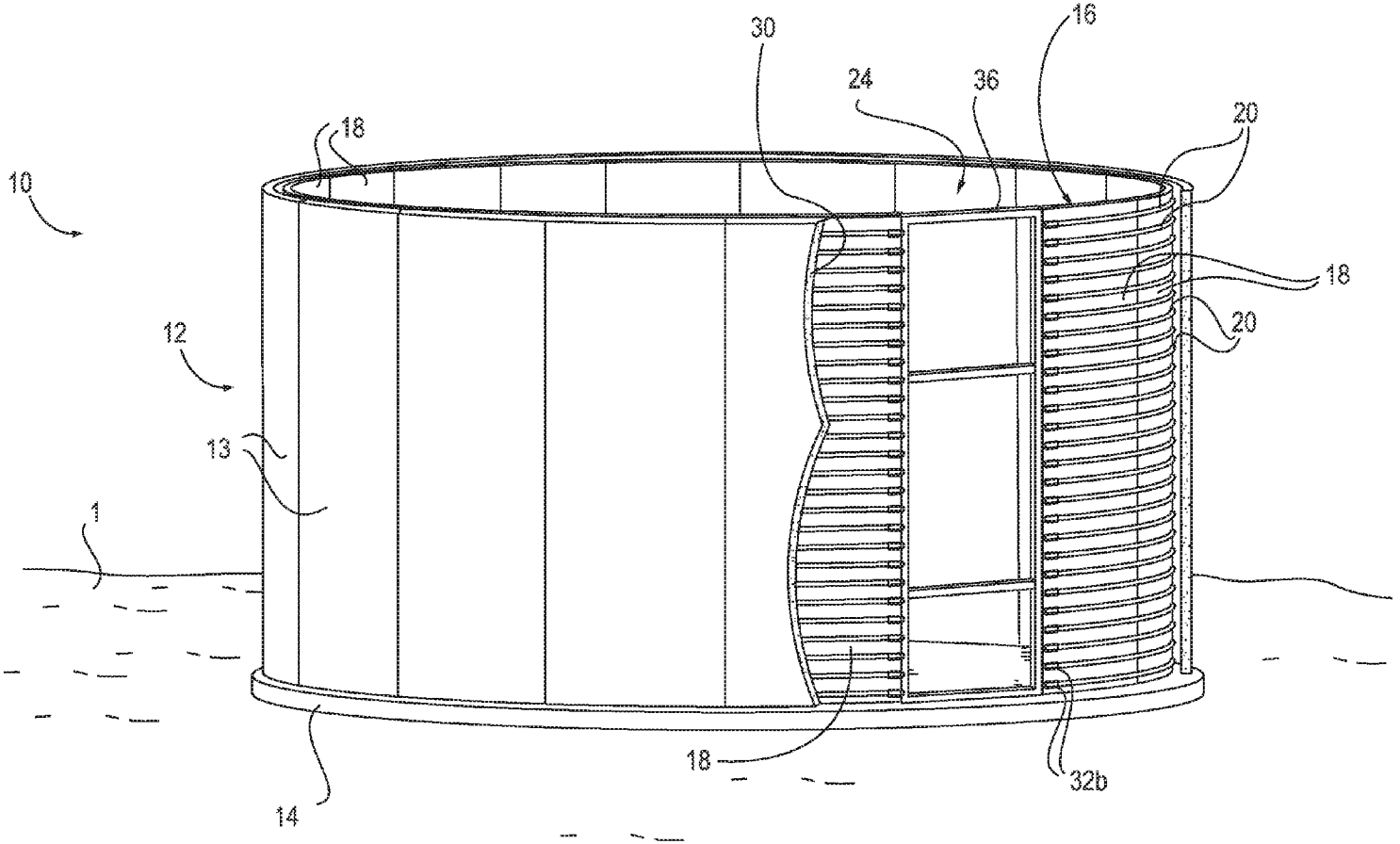
FIG. 3B is an illustration of a liquid storage tank during construction according to another exemplary embodiment.

In one embodiment, the anchors 32 can be affixed to first and second vertical members, which in turn are attached to the two vertical edges adjacent the opening 8 of the inner tank wall 16. The anchors 32 can be attached to the first and second vertical members, or the anchors 32 can be integral to the first and second vertical members. With reference to FIG. 3A, in one embodiment, the first and second vertical members 36*a* and 36*b* can be components of a structural frame 36 which is installed in the opening 8 in the inner tank wall, and the anchors 32 are attached along the height of the first and second vertical members. In one embodiment, the structural frame 36 includes an upper horizontal member 36*c* connecting the first and second vertical members 36*a* and 36*b* at an uppermost height, and a lower horizontal member 36*d* connecting the first and second vertical members 36*a* and 36*b* at a lowermost height. In one embodiment, the structural frame further includes at least one intermediate horizontal member 36*e* connecting the first and second vertical members 36*a* and 36*b* at an intermediate height between the uppermost height and the lowermost height. The lowermost intermediate horizontal member 36*e* is positioned at a minimum desired height h to allow the passage of people and equipment through the opening 8 during construction of the tank 10. The structural frame 36 can be formed of carbon steel or any metal alloy compatible with the requirements of the application depending on the liquid to be stored in the tank 10. In one embodiment, the structural frame 36 can include an optional crossbar support 35 to provide additional structural support during the construction of the tank 10. FIG. 3B illustrates the use of an alternative structural frame 36 not including the crossbar support 35. The anchors 32 are positioned along the vertical height of the structural frame 36 along the first and second vertical members 36*a* and 36*b* at a desired spacing.

Once the inner tank wall 16 with the opening 8 is completed and wire wrapped, the storage tank can at this point be considered partially completed, and workers at the construction site can continue to pass through the opening 8 in the partially constructed storage tank.

In one embodiment, an optional outer tank 12 is constructed from panels 13 on the foundation 14 surrounding the inner tank wall 16 and spaced a distance from the inner tank wall 16, e.g., a distance of few feet. The outer tank 12 is partially constructed such that the area of the opening 8 in the inner tank wall 16 is not completed at this point. The unfinished opening in the outer tank 12 is larger than the opening 8 in the inner tank wall 16.

Figure 4A:
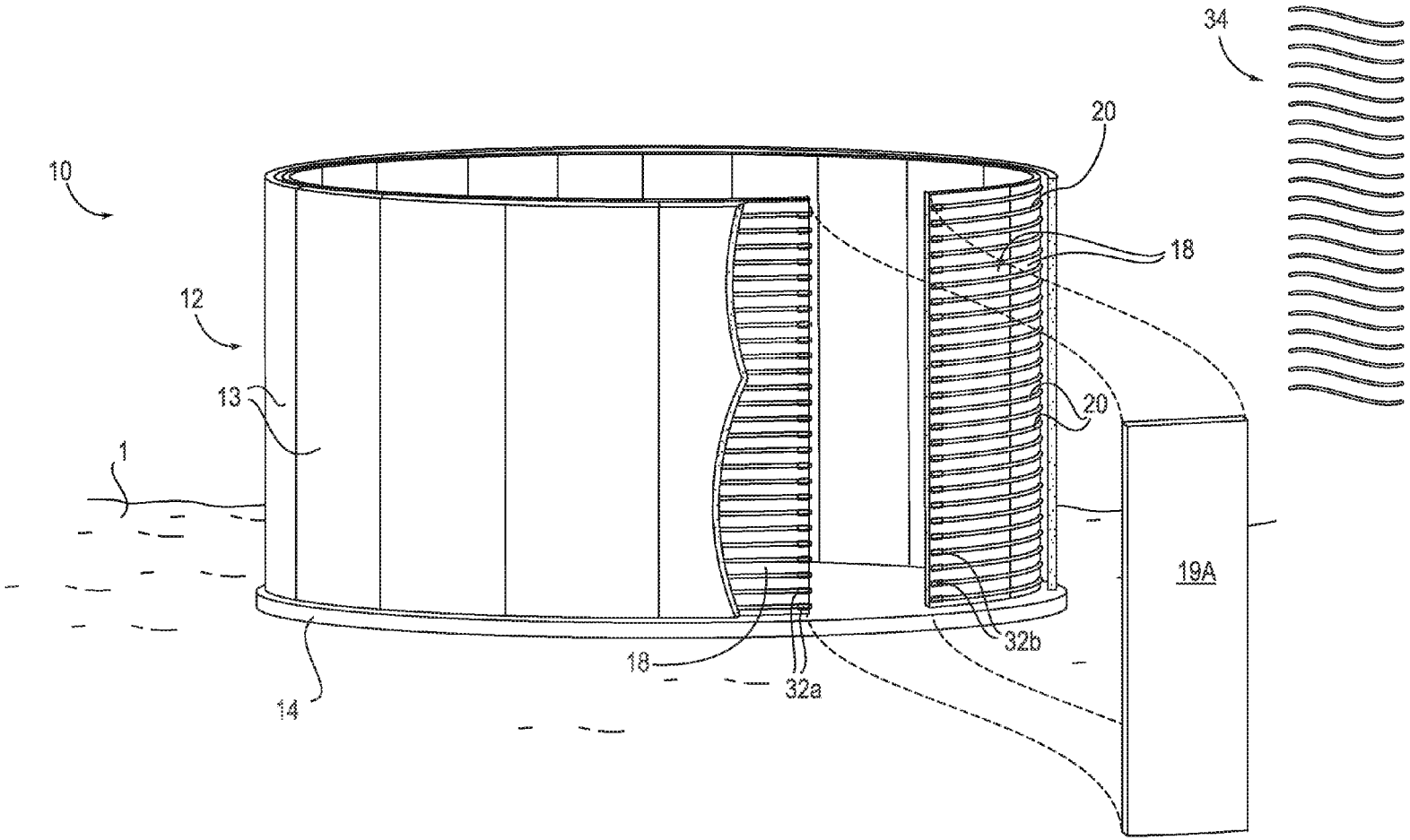
FIG. 4A is an illustration of the liquid storage tank illustrated in FIG. 2 at another phase of construction.

Once the work within the partially constructed storage tank is completed and there is no longer a need to enter the space tank interior 24, concrete panels 19 can be installed in the opening 8 in the inner tank wall 16 to seal the opening 8. The concrete panels 19 are installed by any suitable method, and grounded and/or welded as appropriate. The concrete panels 19 can be full height concrete panels 19A as shown in FIG. 4A or partial height concrete panels 19B, 19C and 19D, as shown in FIG. 3A. In some embodiments, the structural frame 36 is removed from the inner tank wall 16 prior to installing the concrete panels 19.

Figure 4B:
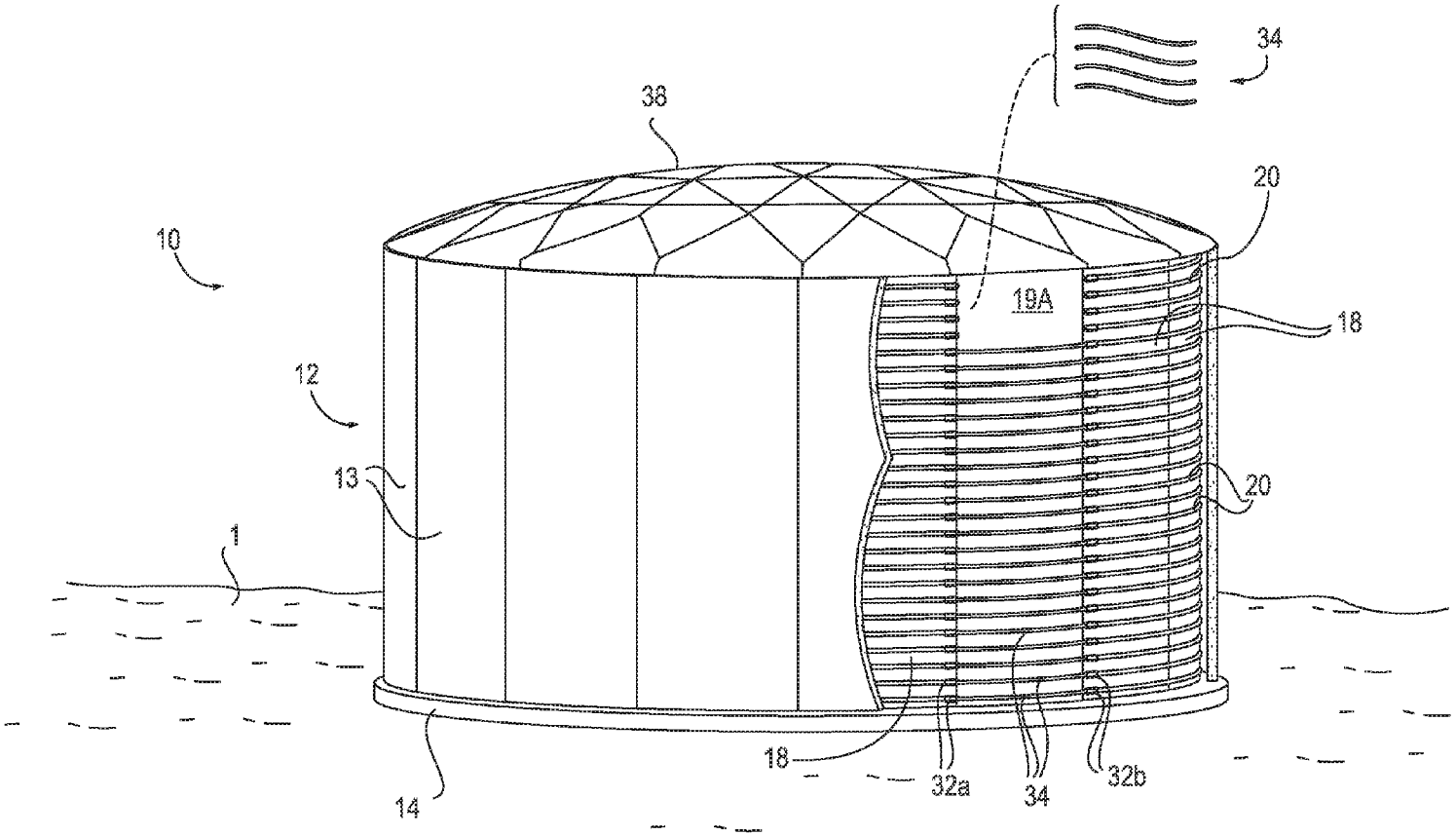
FIG. 4B is an illustration of the liquid storage tank illustrated in FIG. 2 at yet another phase of construction.

FIG. 4B illustrates the tank 10 at a stage of construction when the majority of the strands 34 have been installed across the sealed opening.

Figure 5:
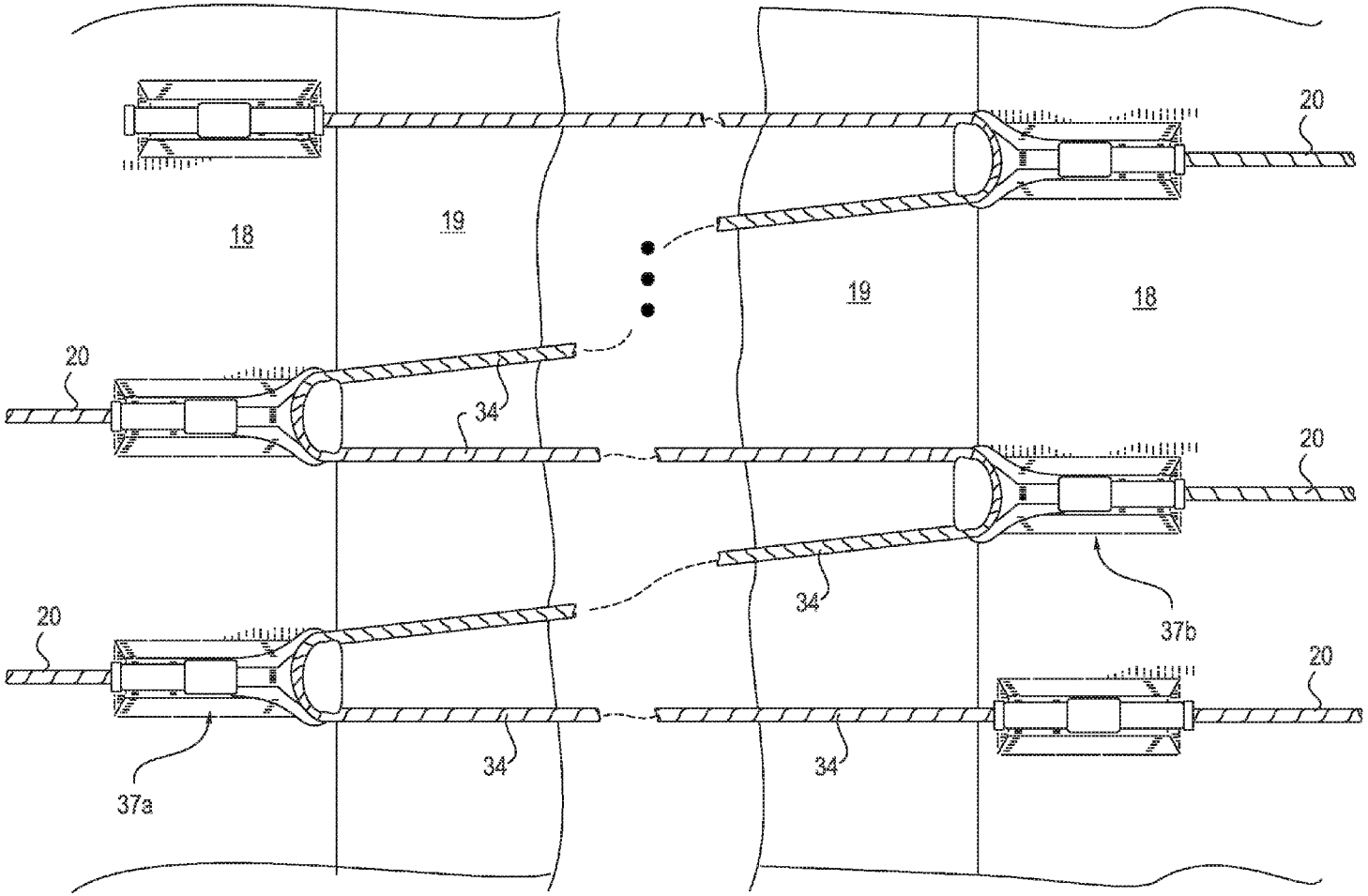
FIG. 5 is a detail illustration of anchors suitable for use in the construction of a liquid storage tank according to one exemplary embodiment.
Figure 6:
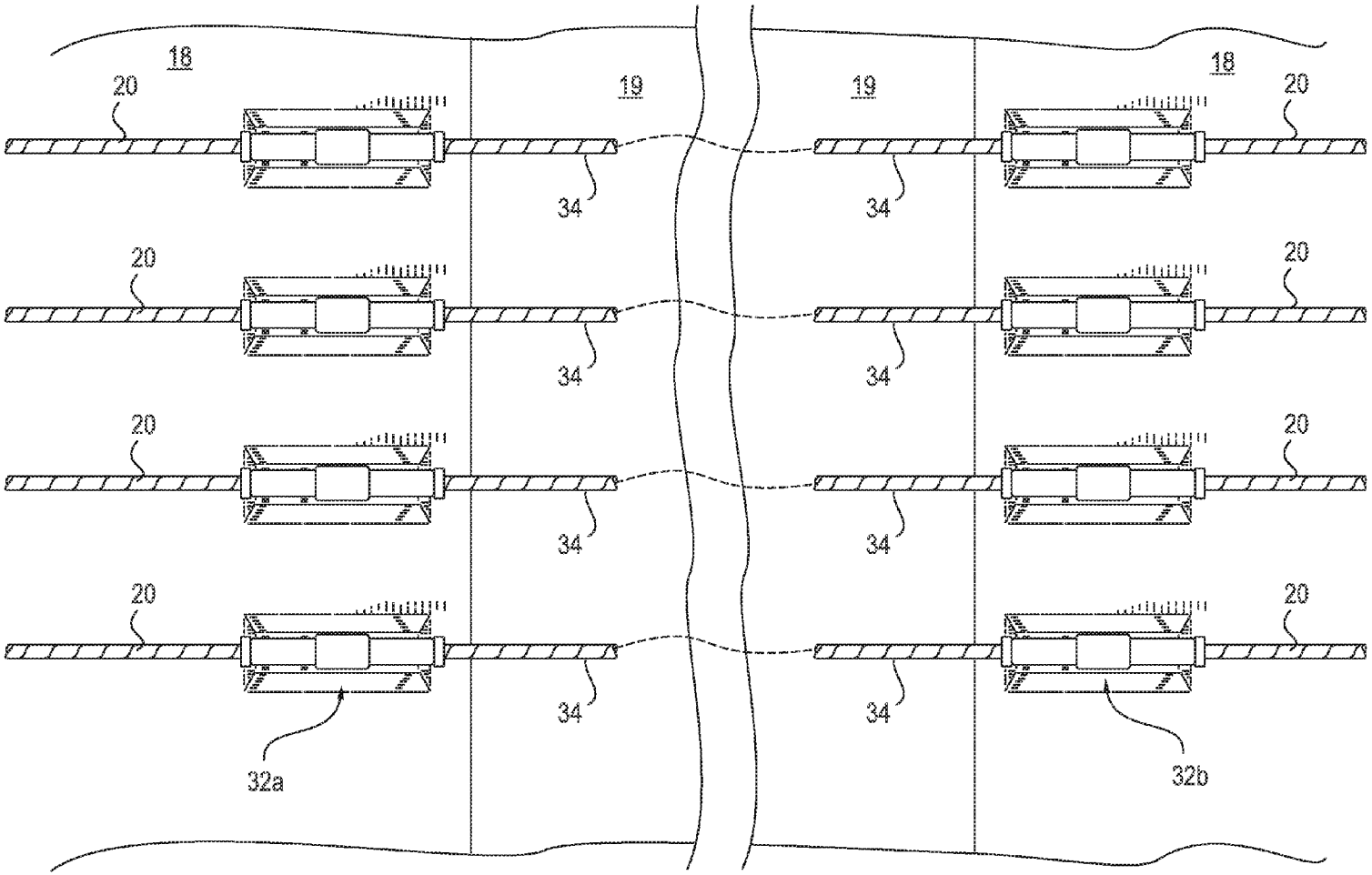
FIG. 6 is a detail illustration of anchors suitable for use in the construction of a liquid storage tank according to another exemplary embodiment.

Once the opening 8 is sealed, a strand 34 is securely inserted into one of the anchors adjacent the sealed opening. The strand is extended to the anchor across the sealed opening horizontally aligned with the anchor into which the strand is inserted. In one embodiment, as shown in FIG. 5, anchors 37*a* and 37*b* are designed to allow the strand 34 to pass back and forth successively between anchors 37*a* and 37*b* at each of the plurality of locations along the two vertical edges adjacent the opening 8, passing over the sealed opening.

In an alternate embodiment, the strand 20 is inserted in one anchor 32*a* and extended under tension to the anchor 32*b* across the sealed opening horizontally aligned with the anchor 32*a* and is then cut and inserted into the anchor 32*b*. The strand 20 is stressed or post-tensioned under the required tension prior to being anchored, using a jack.

Once the opening 8 is sealed and prestressed so that the entire inner tank is wrapped with strands 20, the secondary or outer tank wall is completed by erecting and joining the remaining concrete panels, and completing any desired finishing steps such as grouting, welding and the like. The outer tank is optionally wire wrapped using customary full circumferential wrapping and optional application of Shotcrete. As shown in FIG. 4B, a roof 38 can be installed using a system of precast concrete columns and spine beams that are spanned with prestressed concrete roof panels. At this point, the storage tank 10 is now fully constructed.

It should be noted that only the components relevant to the disclosure are shown in the figures, and that many other components normally part of a prestressed panel walled storage tank are not shown for simplicity.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A method for constructing a storage tank having a generally cylindrical shape, comprising:

a. constructing an inner tank wall comprising concrete panels on a foundation wherein the inner tank wall has an outer surface and an opening in the inner tank wall defined by an opening height and two vertical edges spaced a width apart, the opening provided to allow the passage of people and equipment there through prior to step (e) of the method;

b. anchoring at least a first elongated tensile member to the outer surface of the inner tank wall at a first plurality of locations along one of the two vertical edges adjacent the opening;

c. wrapping the outer surface of the inner tank wall with the at least a first elongated tensile member;

d. anchoring the at least a first elongated tensile member to the outer surface of the inner tank wall at a second plurality of locations along the other of the two vertical edges adjacent the opening such that each of the first plurality of locations is horizontally aligned with each of the second plurality of locations;

e. installing concrete panels in the opening in the inner tank wall to create a sealed opening;

f. anchoring at least a second elongated tensile member to the outer surface of the inner tank wall at a first plurality of locations along one of the two vertical edges adjacent the opening;

g. wrapping the sealed opening with the at least a second elongated tensile member; and h. anchoring the at least a second elongated tensile member to the outer surface of the inner tank wall at a second plurality of locations along the other of the two vertical edges adjacent the opening.

2. The method of claim 1, wherein the inner tank wall has an inner tank wall height and the opening height is equal to the inner tank wall height.

3. The method of claim 1, wherein:

the wrapping of step (c) comprises passing the at least a first elongated tensile member back and forth successively between each of the first plurality of locations and each of the second plurality of locations over the outer surface of the inner tank wall; and the wrapping of step (g) comprises passing the at least a second elongated tensile member back and forth successively between each of the first plurality of locations along one of the two vertical edges adjacent the opening and each of the second plurality of locations along the other of the two vertical edges adjacent the opening over the sealed opening.

4. The method of claim 1, wherein:

the wrapping of step (c) comprises passing each of a first plurality of elongated tensile members successively between each of the first plurality of locations and each of the second plurality of locations over the outer surface of the inner tank wall; and the wrapping of step (g) comprises passing each of a second plurality of elongated tensile members successively between each of the first plurality of locations and each of the second plurality of locations over the sealed opening.

5. The method of claim 1, wherein:

the anchoring of step (b) comprises attaching a first plurality of anchors to the outer surface of the inner tank wall at the first plurality of locations wherein each of the first plurality of anchors is capable of securely holding two elongated tensile member ends; and inserting an end of each of a first plurality of elongated tensile members into each of the first plurality of anchors;

the anchoring of step (d) comprises attaching a second plurality of anchors to the outer surface of the inner tank wall at the second plurality of locations wherein each of the second plurality of anchors is capable of securely holding two elongated tensile member ends; and inserting an end of each of the first plurality of elongated tensile members into each of the second plurality of anchors;

the anchoring of step (f) comprises inserting an end of each of a second plurality of elongated tensile members into each of the first plurality of anchors; and the anchoring of step (h) comprises inserting an end of each of the second plurality of elongated tensile members into each of the second plurality of anchors.

6. The method of claim 5, wherein the first and second pluralities of anchors are attached to the outer surface of the inner tank wall at the first and second pluralities of locations by attaching a first vertical member and a second vertical member, respectively, to the two vertical edges adjacent the opening; wherein the first and second vertical members have the first and second pluralities of anchors affixed thereto, respectively.

7. The method of claim 5, further comprising installing a structural frame in the opening wherein the structural frame comprises a first vertical member having a height attached to one of the two vertical edges adjacent the opening; a second vertical member having a height attached to the other of the two vertical edges adjacent the opening;

wherein the first plurality of anchors is attached along the height of the first vertical member; and the second plurality of anchors is attached along the height of the second vertical member.

8. The method of claim 7, wherein the structural frame further comprises an upper horizontal member connecting the first vertical member and the second vertical member at an uppermost height; and a lower horizontal member connecting the first vertical member and the second vertical member at a lowermost height.

9. The method of claim 8, wherein the structural frame further comprises an intermediate horizontal member connecting the first vertical member and the second vertical member at a height intermediate the uppermost height and the lowermost height.

10. The method of claim 1, wherein the at least a first elongated tensile member and the at least a second elongated tensile member are selected from the group consisting of a strand, a wire, and a tendon.

11. The method of claim 1, further comprising, after step (d) and prior to step (e), constructing an outer tank on the foundation surrounding the inner tank wall and spaced a distance from the inner tank wall.

* * * * *